United States Patent [19]

Kretzschmar

[11] Patent Number: 4,689,726

[45] Date of Patent: Aug. 25, 1987

[54] LIGHTING MECHANISM

[76] Inventor: Thomas E. Kretzschmar, 4533 Verone, Bellaire, Tex. 77401

[21] Appl. No.: 834,956

[22] Filed: Feb. 28, 1986

[51] Int. Cl.[4] ..... A47B 97/00

[52] U.S. Cl. ..... 362/127; 362/226; 362/250; 312/223

[58] Field of Search ..... 362/223, 226, 253, 249, 362/127, 219, 250, 220, 227, 33, 151, 133, 368, 370; 312/223; 339/21 R

[56] References Cited

U.S. PATENT DOCUMENTS

| | | | |
|---|---|---|---|
| 1,927,837 | 9/1933 | Kingdon | 312/223 |
| 3,187,172 | 6/1965 | Knapp et al. | 362/226 |
| 3,725,746 | 4/1973 | Carroll | 312/223 |
| 3,963,913 | 6/1976 | Donovan et al. | 362/127 |
| 4,232,183 | 11/1980 | Person | 174/48 |
| 4,454,569 | 6/1984 | Maguire | 362/127 |
| 4,521,838 | 6/1985 | Agabekov | 362/219 |

FOREIGN PATENT DOCUMENTS

| | | | |
|---|---|---|---|
| 3142858 | 5/1983 | Fed. Rep. of Germany | 312/223 |
| 1379276 | 1/1975 | United Kingdom | 312/223 R |

*Primary Examiner*—William A. Cuchlinski, Jr.
*Assistant Examiner*—D. M. Cox
*Attorney, Agent, or Firm*—Robert W. B. Dickerson

[57] ABSTRACT

A mechanism for lighting an article of furnishing, such as a bookcase with adjustable shelves, comprising a fixture laterally extending along a shelf, said shelf being adjustably positionable along a combination electrical conductor and shelf positioner, said fixture including an electrically conductive strip, a plurality of series connected electrical terminals, and a plurality of lamp means, each connecting said strip and one of said terminals.

6 Claims, 14 Drawing Figures

FIG. 1
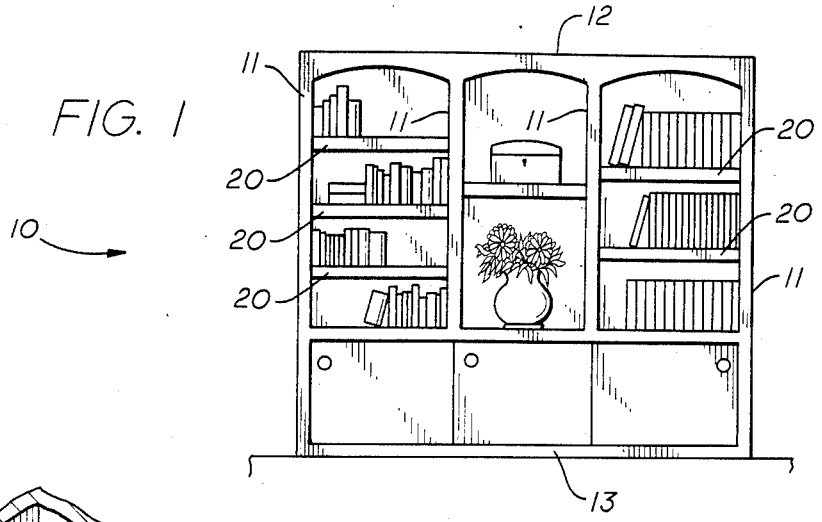
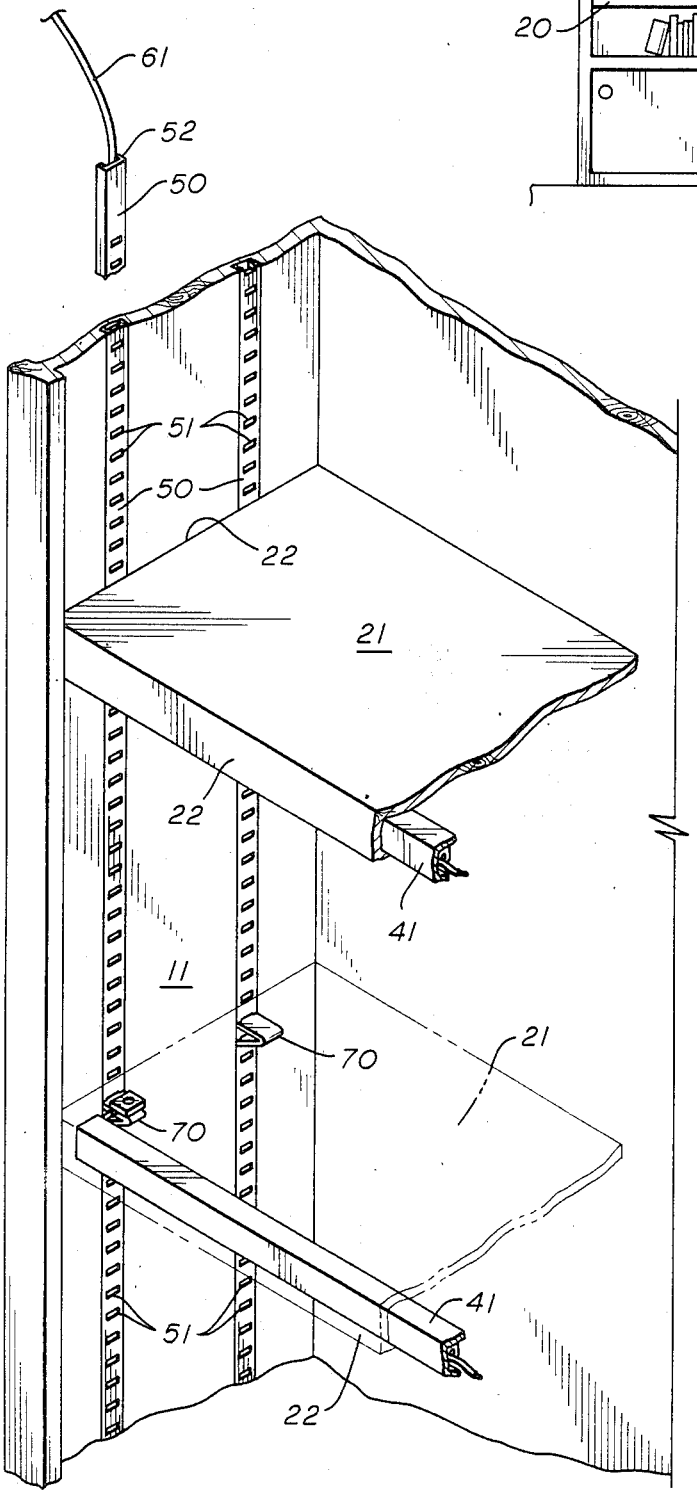
FIG. 2

LIGHTING MECHANISM

BACKGROUND OF THE INVENTION

Various types of lighting devices have been used to illuminate objects particularly intended to be see, such as items of furnishings and of art, as well as housing and store interiors. Oftentimes such a source of light is so positioned as to be generally non-obvious, such as in a recessed location. A search ordered on such arrangements produced the following U.S. Pat. Nos. 1,767,262; 2,714,712; 3,187,172; 3,218,448; 3,527,933; 3,582,868; 4,158,221; 4,164,009; 4,521,838; and 4,544,991.

Many such prior art devices included extended strips of electrically conductive material, such strips carrying spaced, lamp-receiving terminals, such devices creating a low-profile, linear lighting system. Each such conductive strip, however, must apparently be individually linked to a source of low voltage current. In lighting a multi-shelved structure, an excess of wiring is encountered. It was to simplify such a multi-shelf lighting mechanism that Applicant's invention was developed.

SUMMARY OF THE INVENTION

A bookshelf is an example of multi-shelf structure. It may be desirable to light each shelf area. This may occur by providing a lighting mechanism to the undersurface, or preferably to the inside surface of a lip depending therefrom, of the shelf or structure immediately above such area. Each shelf may be individually, vertically adjustable, by virtue of a plurality of slotted standards provided the vertical side walls of the furnishing. Normally, four such standards are used, one for each shelf corner. Applicant's invention contemplates using the standards for an electrically conductive function in addition to a placement function. A source of low voltage emf would be linked to a pair of oppositely positioned standards. The fixture of this invention would linearly extend across each shelf's front, as well as the ledge or cornice depending from the furnishing's upper wall. Conceivably, alternate, such as at the shelf rear, placement fixture may suffice. Such fixture would include an electrically conductive strip, a plurality of lamp-receiving brackets depending therefrom, as well as electrical leads connecting one of said standards to said conductive strip and the other standard to a plurality of electrically linked lamps provided intermediate pairs of said brackets.

DESCRIPTION OF THE DRAWINGS

FIG. 1 is a front elevation of a typical book shelf structure;

FIG. 2 is a broken perspective of a portion of the structure of FIG. 1;

DESCRIPTION OF A PREFERRED EMBODIMENT

Looking first at FIG. 1, a typical book-shelf structure 10 is shown to have a plurality of shelves 20 suspended between adjacent vertical walls 11. Such vertical walls are secured by horizontal top and bottom walls 12 and 13. It goes without saying that the book-shelf is merely illustrative, ie, that this invention may have utility with a number of other furnishings and structures.

Figure 3:
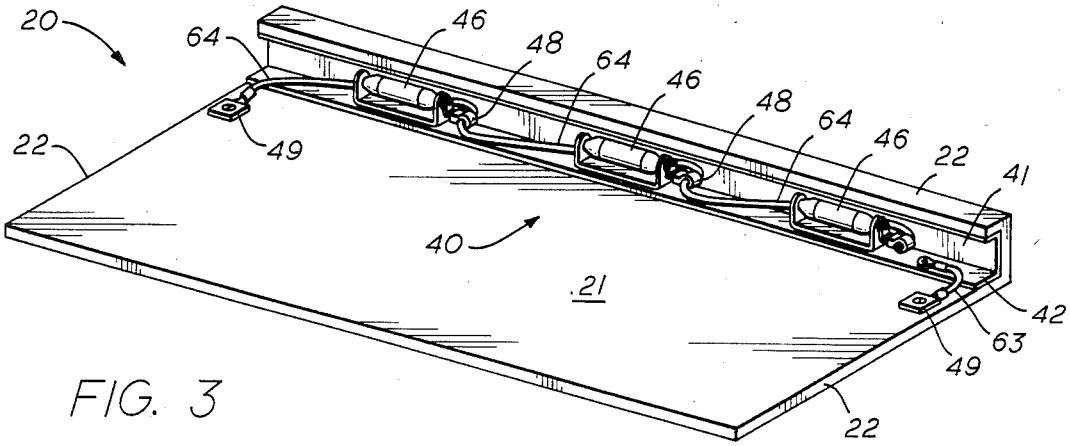
FIG. 3 is a perspective of the underside of one shelf of the structure of FIG. 1.
Figure 4:
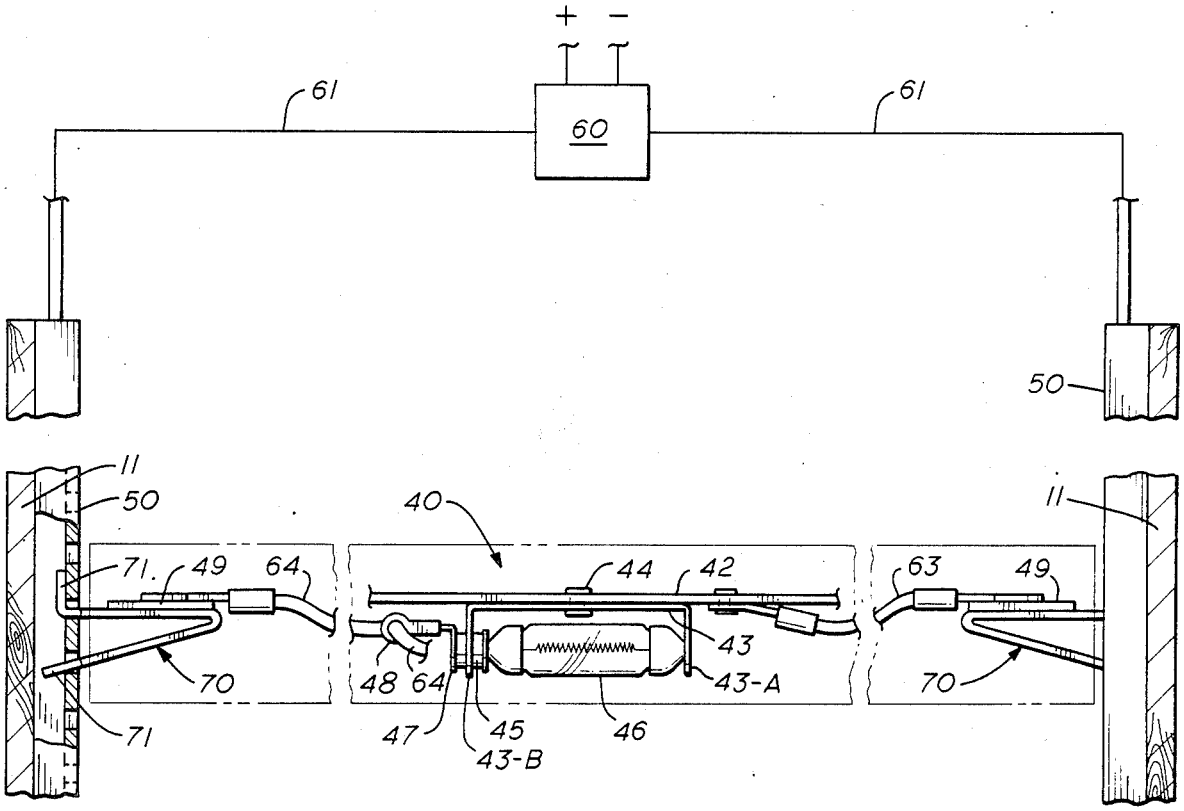
FIG. 4 is a partly schematic, broken, front elevation of the fixture linked to a pair of vertical standards.
Figure 5:
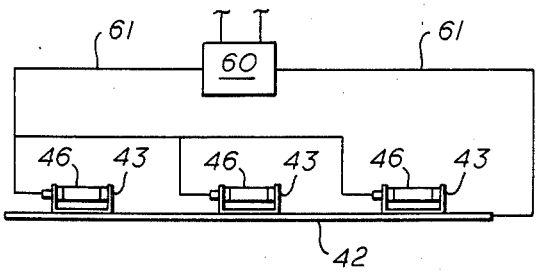
FIG. 5 is a schematic of the electrical circuitry.

The shelves, as are more clearly illustrated in FIGS. 2 and 3, include a generally flat deck 21, with a depending lip or ledge 22 at the front of the deck. The lighting fixture of this invention, generally illustrated at 40, would normally be secured to and positioned at or near the juncture of said deck and lip. However, it should be clearly understood that the frame 41 of fixture 40 may take a plethora of configurations, so as to accommodate the surrounding structure, as illustrated by members 41-A through 41-E in FIGS. 10–14. As illustrated in FIGS. 2 and 4, each vertical wall includes a pair of slotted vertical standards 50, adjacent each lateral edge 22 of shelves 20. These standards include a plurality of spaced slots 51. The standards themselves may be imbedded in the wall face or attached to such face. In the embodiment of FIG. 2, the standards 50 are immediately adjacent their respective shelves. On the other hand, in the embodiment of FIGS. 6, 7 and 8, standards 50-A are imbedded a vertical recess 50-B in the opposite face of vertical wall 11.

Figure 6:
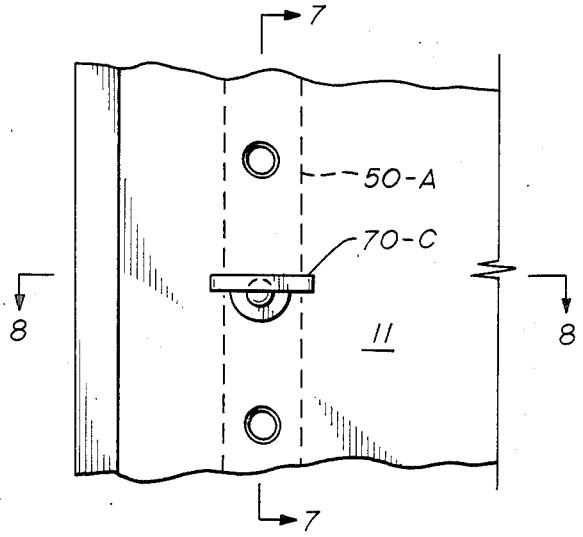
FIGS. 6, 7 and 8 are, respectively, a side elevation, a vertical section taken along lines 7—7 of FIG. 6, and a horizontal section taken along lines 8—8 of FIG. 6, all depicting an alternate position of the vertical standards relative to the vertical walls of the book shelf.
Figure 7:
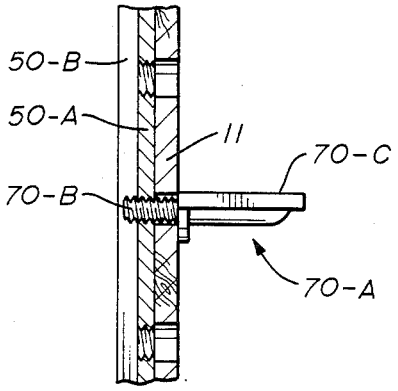
Figure 8:
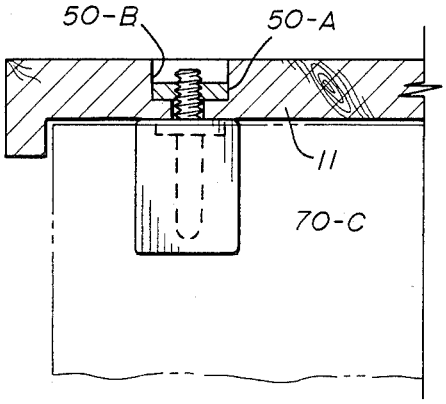
Figure 9:
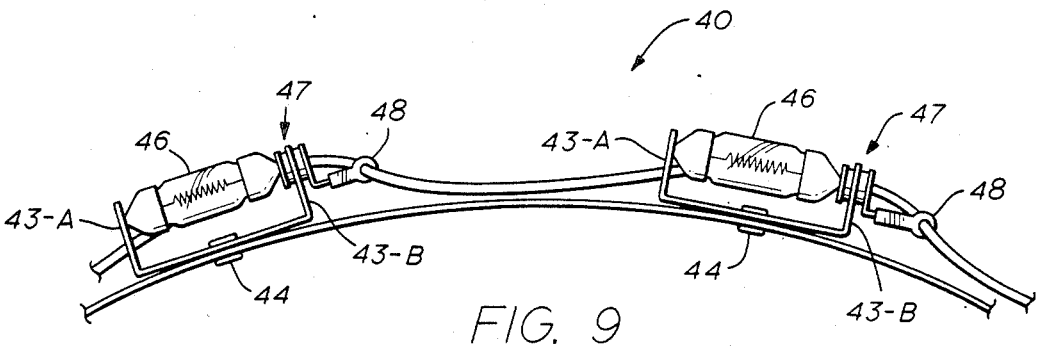
FIG. 9 is a broken front elevation of the fixture, wherein the conductive strip may be linearly curved.
Figure 10:
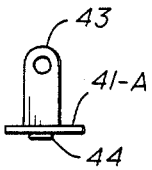
FIGS. 10, 11, 12, 13 and 14 are end elevations of the fixture, illustrating different fixture frame configurations permitted, so as to adapt to differently shaped furnishings or structure.
Figure 11:
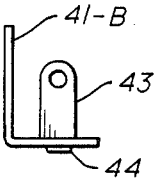
Figure 12:
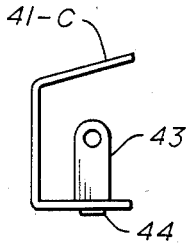
Figure 13:
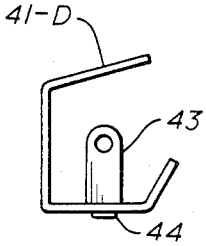
Figure 14:
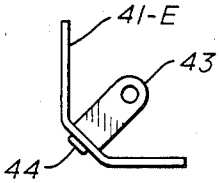

FIG. 4 indicates, at 60, a source of low voltage, emf (usually 12 or 24 volts), which may be a transformer. Electrical leads 61 connect opposite ends of member 60 to like ends 52 of a pair of electrically conductive standards 50 (or 50-A). Previously mentioned slots 51 are dual purpose. The insertion of both legs 71 of standard metallic clips or hooks 70 through adjacent slots 51 not only serves at an adjustable support for shelf 20, but also, with regard to the pair of standards linked to source 60, provides an electrical bridge to the electrical fixture carried by the associated shelf 20. In the case of FIGS. 6–8, in place of clip 70, connector 70-A (Which may be threaded, at at 70-B) includes a pad 70-C, on which a shelf 20 may rest. The connector being electrically conductive, standard 50-A may be electrically linked to the shelf-carried fixture 40. Now consider said fixture.

As previously mentioned frame 41 of fixture may vary in configuration. The entire frame may be electrically conductive, or only a strip, such the side flange 42. Spaced along the frame, a series of U-shaped brackets 43 are riveted, as by rivet 44, thereto. One bracket leg 43-A may be recessed to conductively receive one end of lamp 46. The other lamp end is received by electrical terminal 47, said terminal extending through leg 43-B of bracket 43, and insulated therefrom by insulation spool 45. Metal connectors or pads 49 are affixed to the undersurface of shelf deck 21. One such pad, through lead 63 is secured to conductive frame 41, or its conductive strip if the entire frame is not conductive. The other connector 49, through lead 64, is series joined to each terminal 47, through a crimped ring 48. Thus, each lamp is connected across conductive frame 41 or its conductive strip.

In operation, each shelf or upper wall, carrying a lighting fixture, is in electrical communication with a pair of vertical standards. Such standards are energized by source 60. Each bracket is joined to conductive frame 41. Each lamp closes the circuit between one bracket end and terminal 47, which terminal, by crimped ring 48 is conductively linked to lead 64. Thus as the shelf is positioned atop clips or hooks 70 or 70 A, with connectors 49 in communication therewith, the lamps are energized.

Although limited embodiments have been described, it should be obvious that numerous modifications are possible by one skilled in the art without departing from the spirit of the invention, the scope of which is limited only by the following claims.

I claim:

1. A lighting mechanism for use in a structure having at least one adjustably positionable shelf structure, said mechanism including:

at least a pair of electrically conductive standards comprising a portion of said structure, said standards each comprising combination means for adjustably securing a shelf thereto, and for permitting the establishing of electrical communication between a source of power and a lighting fixture;

at least one said shelf including said lighting fixture said lighting fixture including;

an electrically conductive strip, a plurality of lamps, and means for establishing electrical communication between said standards and said lamps and strip, said lighting fixture further including;

said lamps being connected in series, and said means for establishing electrical communication between said standards and said lamps and strip includling means for establishing electrical communication between one end of each of said lamps and one of said standards, and also including means for establishing electrical communication between the other end of each of said lamps and said conductive strip, and further including means for establishing electrical communication between said conductive strip and another of said standards.

2. The mechanism of claim 1 and including a plurality of electrically conductive brackets spaced along said strip, each said lamp being secured to spaced bracket legs.

3. A lighting mechanism for use in a structure having vertically adjustable shelves, said mechanism comprising;

at least a pair of electrically conductive standards secured to said structure;

at least one of said shelves including said lighting fixture, said lighting fixture including;

an electrically conductive strip, a plurality of lamps each being electrically connected across said strip, a plurality of conductive brackets spaced along said strip, each said lamp being secured to spaced bracket legs, one lamp end of each lamp being in electrical communication with its respective bracket leg and the other lamp end being insulated from its respective bracket leg.

4. The mechanism of claim 3 and including a source of e.m.f. in electrical communication with said standards.

5. A lighting mechanism for use in a structure having vertically adjustable shelves, said mechanism comprising;

at least a pair of electrically conductive standards secured to said structure, each said standard including combination means for adjustable securing a shelf thereto and establishing electrical communication with one of an electrically conductive strip and said lamps;

at least one of said shelves including said lighting fixture, said lighting fixture including;

said electrically conductive strip, a plurality of lamps each being electrically connected across said strip, a plurality of conductive brackets spaced along said strip, each said lamp being secured to spaced bracket legs, one lamp end of each lamp being in electrical communication with its respective bracket leg and the other lamp end being insulated from its respective bracket leg.

6. The mechanism of claim 5 and including a source of e.m.f. in electrical communication with said standards.

* * * * *